United States Patent [19]

Kettner

[11] Patent Number: 4,822,264

[45] Date of Patent: Apr. 18, 1989

[54] REVERSIBLE TWIN-CHAMBERED COMPRESSED-AIR MOTOR

[75] Inventor: Konrad K. Kettner, Aalen-Hofherrnweiler, Fed. Rep. of Germany

[73] Assignee: Cooper Industries, Inc., Houston, Tex.

[21] Appl. No.: 37,270

[22] Filed: Apr. 10, 1987

Related U.S. Application Data

[63] Continuation-in-part of Ser. No. 823,549, Jan. 29, 1986, abandoned.

[30] Foreign Application Priority Data

Jan. 30, 1986 [DE] Fed. Rep. of Germany ..... 3503032

[51] Int. Cl.[4] ..... F01C 1/344; F01C 13/02; F01C 21/12

[52] U.S. Cl. ..... 418/150; 418/270; 173/163

[58] Field of Search ..... 418/259, 266–270, 418/150; 173/163; 415/503

[56] References Cited

U.S. PATENT DOCUMENTS

| | | | |
|---|---|---|---|
| 1,931,167 | 10/1933 | Price | 418/270 |
| 2,575,524 | 11/1951 | Mitchell | 418/270 |
| 3,429,230 | 2/1969 | Quackenbush | 418/270 |
| 3,439,422 | 4/1969 | Doeden | 418/270 |
| 3,614,275 | 10/1971 | Eibsen | 418/270 |
| 3,827,834 | 8/1974 | Kakimoto | 418/270 |
| 4,299,097 | 11/1981 | Shank | 418/150 |
| 4,344,146 | 8/1982 | Leonard | 418/270 |

FOREIGN PATENT DOCUMENTS

| | | | |
|---|---|---|---|
| 30378 | 11/1959 | Finland | 418/270 |

*Primary Examiner*—John J. Vrablik

*Attorney, Agent, or Firm*—Alan R. Thiele; Eddie E. Scott

[57] ABSTRACT

In reversible compressed air rotary motors for compressed air tools, particularly for wrenches, it is known to discharge the waste air radially from the casing of the motor, which results in a considerable nuisance, in particular as regards noise. Furthermore, due to the close positioning of the compressed air inlet and air outlet, poor efficiency is achieved. To avoid those drawbacks in a rotary sliding vane motor having an elliptical working chamber, the rotor end over on the inlet side is rotatably mounted, and air outlet means is arranged axially and lies in both the clockwise as well as in the antic-clockwise direction or rotation of the rotor relative to the major semi-axis of the elliptical working chamber. Thus by rotating the end cover to one or other of its limit positions, the outlet means communicate with different pairs of passageways.

18 Claims, 6 Drawing Sheets

REVERSIBLE TWIN-CHAMBERED COMPRESSED-AIR MOTOR

This application is a Continuation-in-Part of application Ser. No. 823,549, filed on Jan. 29, 1986 now abandoned.

BACKGROUND OF THE INVENTION

The invention relates to a reversible compressed air motor for compressed air tools, in particular for compressed air wrenches.

A compressed air wrench of this type is known from German OS No. 21 24 149. Axial channels for the supply of air are provided in a rotor cover which closes off the cylinder formed in the casing, in which cover one end of the rotor is mounted. The channels open into the compressed air inlet provided in the cylinder, which supplies compressed air radially to an expansion chamber.

During the rotation of the rotor, after travelling past the compressed air inlet, the expansion chamber is connected to a radial air outlet which consists of bores in the cylinder arranged one behind the other in the axial direction in the plane of the major semi-axis, which bores discharge the compressed air radially. The compressed air escaping radially interferes considerably with the operation of the compressed air wrench, so that basically deflection pockets for the compressed air are provided, which necessitates additional construction expenditure.

Furthermore it has been found that on account of the radial outlet openings lying diametrically with respect to each other, and the intermittent escape of waste air, the cylinder wall is subjected intermittently to pressure surges, which leads to vibrations and pressure surge agitation of the entire compressed air wrench. These vibrations lead to considerable air noise of a high sound level. Therefore, as a rule, additional structural means must be provided in order to reduce the nuisance as regards noise and vibration to a tolerable limit.

The known compressed air motor is a twin-chamber motor and in all has four radial compressed air inlets separated from each other, which each lie in one quadrant of the elliptical cross section. Two diametrically opposed inlets respectively are provided for clockwise or anti-clockwise rotation of the motor, in which case the inlets are located close to the minor semiaxis. The radial outlet openings are provided in the plane of the major semi-axis, the overall construction being symmetrical both with respect to the minor as well as to the major semi-axis. This symmetrical arrangement produces a relatively small expansion space for the compressed air introduced, in which it must exert accelaration forces on the rotor. Since the opening of the outlet openings already begins when the leading vane in the direction of travel is located at the apex of the inner contour, the expansion work of this construction is relatively low. Since moreover it must be ensured that the compressed air inlet and air outlet cannot be connected directly to each other, a certain spacing of the vanes or minimum number of vanes is absolutely necessary. However, a high number of vanes implies a high air consumption.

For reversing the motor from one direction of rotation to the other, a separate reversing valve is provided, which guides the compressed air supplied either through one pair of diametrically opposed inlets for clockwise rotation or through the other pair of opposed inlets for anti-clockwise rotation. On account of the symmetrical arrangement, the torque of the motor in both directions is identical, but relatively low on account of the small expansion chamber.

SUMMARY

The object of the invention is to develop a motor of the aforementioned type, but with which a higher output is achieved with low structural expenditure, the same overall size and quiet operation.

The invention provides a reversible compressed air motor for compressed air tools, comprising a rotor arranged in a cylinder with a substantially elliptical inner contour in axial slots in the surface of which rotor radially movable vanes distributed substantially uniformly over the periphery and extending over substantially the entire length of the cylinder are located, the cylinder being closed off axially by covers located at its end faces and provided between the cylinder and the rotor is at least one expansion chamber defined by vanes for the compressed air, which chamber can be connected alternately to a compressed air inlet and an air outlet depending on the rotary position of the rotor cover at the inlet side, wherein the rotor cover at the inlet side is rotatably mounted, and the air outlet is arranged axially and lies behind the major semi-axis of the inner contour in the direction of rotation of the rotor both in a clockwise direction and in an anti-clockwise direction.

Due to the axial arrangement of the air outlet, the individual components of the compressed air wrench produce little noise. Since the axial air outlets lie behind the major semi-axis in the direction of rotation of the rotor, larger expansion chambers are provided, so that a higher output can be achieved with the same overall size. It has proved advantageous that the distance of the air outlet from the major semi-axis, measured in the peripheral direction, corresponds to approximately half the spacing of the vanes, due to which a relatively great expansion chamber is achieved by utilizing the inner contour of the cylinder.

If the compressed air motor is equipped with diametrically opposed compressed air inlets for clockwise rotation and diametrically opposed compressed air inlets for anti-clockwise rotation, which starting from one end face of the cylinder open out on the inner wall of the cylinder, then it is advantageous to provide in the rotor cover two diametrically opposed, axially continuous intake air channels respectively for clockwise rotation and two correspondingly located channels for anti-clockwise rotation. One pair of intake air channels can be connected to the compressed air inlets for clockwise rotation provided in the cylinder and the other pair can be connected to the compressed air inlets for anti-clockwise rotation, in which case between two respective adjacent intake air bores, one waste air slot is respectively located, whereof the longitudinal axes lie parallel to each other. In an advantageous development of the invention, the cover is mounted to rotate in an air distributor fixed to the casing, in which case the cover can be locked in two rotary positions in an intermediate ring. In a first locked position, one pair of diametrically opposed intake air channels is connected to the compressed air inlets for clockwise rotation and the compressed air inlets for anti-clockwise rotation are connected to the waste air slots, whereas in a second locked position, the other pair of diametrically opposed intake air channels are connected to the compressed air inlets for anti-clockwise rotation and the compressed air inlets for clockwise rotation are connected to the waste air slots. In this way, a reversal of the direction of rotation is possible in a structurally simple design, in that the rotor cover is transferred from one locked position to the other. On the basis of the arrangement according to the invention of the waste air slots and the intake air channels in the rotary rotor cover, a compressed air motor is created for which large expansion chambers and thus high expansion ratios are available in both directions of rotation, due to which high efficiency is achieved. The reversible motor according to the invention has the same high efficiency as a motor rotating solely clockwise or anti-clockwise, which is not reversible.

The bores of the compressed air inlets located on one side of the major semi-axis have a spacing which is slightly greater than the thickness of the vanes. In this way the largest possible peripheral region between a compressed air inlet and the associated outlet or waste air slot is achieved, so that the compressed air supplied to an expansion chamber can perform increased expansion work, thus resulting in an increase in output with the overall size remaining unchanged. With the same overall size, the motor according to the invention has approximately twice the output of a known motor. With the same output, the motor according to the invention has only half the overall axial length of the known compressed air motor. On account of the large peripheral spacing of the compressed air inlet and associated air outlet, the spacing of the vanes may be so great that only a minimum number of vanes is required due to which, apart from an increase in output, lower air consumption is also achieved. Six vanes are preferably provided.

During rotation the vanes of the rotor undergo centrifugal forces and inertia forces, since in the case of a twin-chamber machine, with a revolution of 360°, they move twice radially outwards and inwards again. The outer position of the vanes may thus be referred to as the top dead center and the radially retracted position of the vanes as the bottom dead center.

In a particular embodiment of the invention, the inner contour of the cylinder is advantageously constructed in the form of a double cross loop, in which the acceleration and inertia forces occurring are lowest in comparison with other known curve constructions. The curve of forces on the vane act symmetrically and harmonically. No sudden accelerations occur with a construction of the type. High loads on the vanes are therefore largely avoided, thus resulting in dynamically balanced running at high speeds.

The aforedescribed advantages are achieved in an almost optimum manner even when the inner contour of the cylinder is constructed in the manner of a cassinian curve.

In a development of the invention, in the case of a reversible motor with a reversing device for reversing the direction of rotation, it is provided to actuate the device for reversing the direction of rotation automatically depending on the compressed air stream supplied. Advantageously the reversing device can be actuated by a rotary slide valve, which can be moved by way of a first compressed air connection into a first position and by way of a second compressed air connection into a second position. One position of the rotary slide valve corresponds to the switching position of the reversing device for clockwise rotation, the other position of the rotary slide valve corresponds to the switching position for anti-clockwise rotation.

In connection with the motor according to the invention, the rotary slide valve has a driving connection with the rotor cover in the peripheral direction by way of a pin, so that in a first position of the rotary slide valve, the rotor cover lies in the position for clockwise rotation and in a second position of the rotary slide valve, the rotor cover lies in a position for anti-clockwise rotation.

The accompanying drawings show various features of the invention, which are described in detail hereafter:

DETAILED DESCRIPTION OF THE EMBODIMENTS

Figure 1:
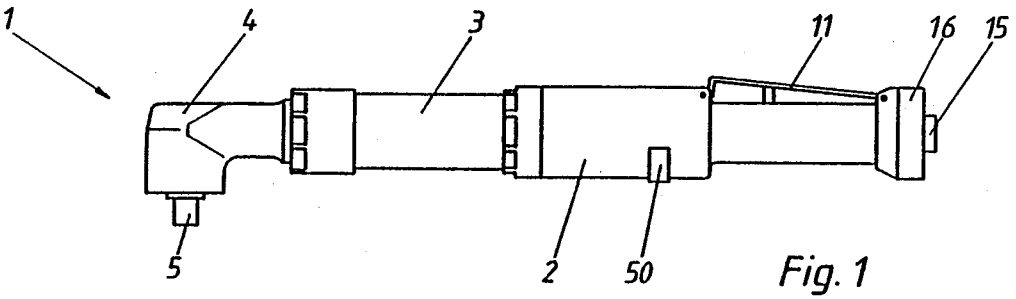
FIG. 1 is a view of a compressed air wrench.

The compressed air wrench 1 has a multi-stage, cylindrical casing with a drive unit 2, a transmission unit 3 and a screw head 4 with a screw spindle 5. A tool is fitted to the screw spindle 5, which tool acts on the screw, nut or the like. Only the drive unit 2 of the compressed air wrench is described hereafter.

The drive unit 2 has a two-stage, cylindrical casing 6. Located in section 7 constructed with a smaller diameter, is an inlet channel 9 able to be closed off by an inlet valve 8, which channel opens centrally into the section 10 of larger diameter.

At its free end the section 7 supports an annular flange 16, in which a starting lever 11 of the compressed air wrench 1, arranged along the section 7, is hinged at one end. The starting lever 11 engages by its other bent end under a stop in a recess in the annular end face of the section 10, in which case the starting lever 11 is acted upon by force in its inoperative position. By way of a sliding piston 12 guided in the casing 6, the starting lever 11 is connected to a rod 13 arranged in the longitudinal direction of the section 7 in the inlet channel 9, attached to one end of which rod is the valve disc of the inlet valve 8. By depressing the starting lever 11, the rod 13 is tilted, due to which the spring-loaded valve disc of the inlet valve 8 is lifted from its sealing seat and the compressed air flowing in at the free end face of the section 7 can enter the inlet channel 9.

Extending beside the inlet channel 9 in the casing 6 and along the section 7 is an outlet channel 14, which starting from the interior of the section 10 opens out in the free end face of the section 7. A correspondingly constructed cover 15 is advantageously provided on the free end face for the connection of the compressed air and for silencing the emerging waste air.

Located in the section 10 is a twin-chamber compressed air motor, whereof the drive shaft is constructed in one piece with the rotor 60. The drive shaft projects from the drive unit 2 into the transmission unit 3.

Located inside the cylindrical section 10 is a distributor 20, which is supported by a cylindrical section 21 with the interposition of a sealing ring 22 on the inner end face 17 of the section 7. The sealing ring 22 is advantageously located in an counter sunk section whereof the diameter corresponds to the outer diameter of the cylindrical section 21, the cylindrical section 21 surrounding the opening of the inlet channel 9 in a tight manner. The distributor 20 has an outer diameter corresponding to the inner diameter of the section 10 and is supported on a peripheral step 23 in the casing, in order to avoid excessive compression of the sealing ring 22 located in the counter sunk section. Starting from the cylindrical section 21, the distributor 20 is bevelled towards the front end face 18 (FIG. 4), so that an annular waste air chamber 24 is defined between the distributor 20 inserted in the casing 6, its cylindrical section 21 and the casing, which chamber is connected to the atmosphere by way of the outlet channel 14.

Figure 4:
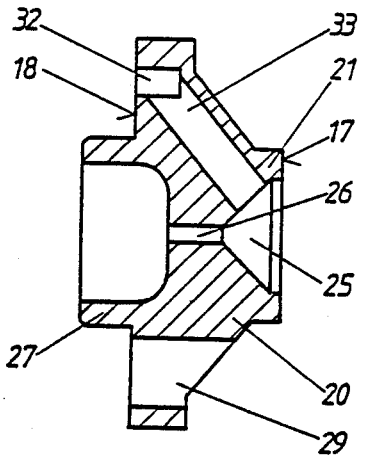
FIG. 4 is a section on line IV—IV of FIG. 3.
Figure 3:
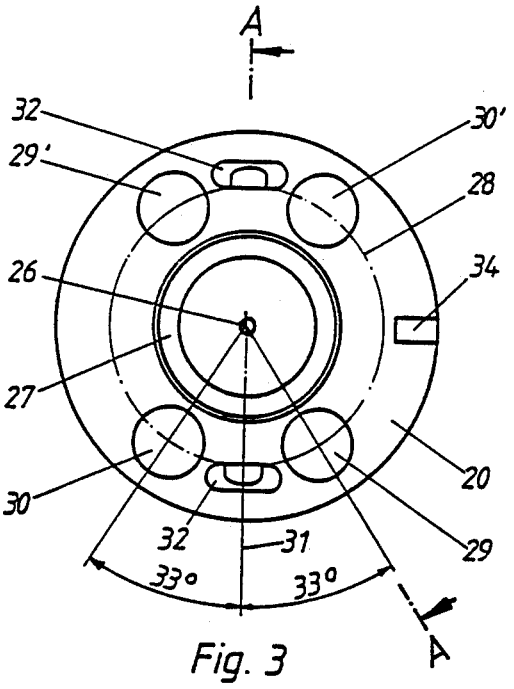
FIG. 3 is a view of a compressed air distributor, seen from the rotor.

The distributor 20 shown to an enlarged scale in FIGS. 3 and 4 comprises a central tapering bore 25 in the section 21, into which the inlet channel 9 opens. Adjoining the tip of the bore 25 is a coaxial connecting bore 26 which is continuous in the axial direction, which at the end face 18 of the distributor 2 remote from the section 21 opens into an axially open, cylindrical projection 27. Provided in the annular surface of the end face 18 surrounding the projection 27 are four axially continuous waste air bores 29, 29', 30, 30', the axes of which lie parallel to each other on a common center point circle 28. Two waste air bores 30, 30' or 29, 29, 29' respectively lie diametrically opposite each other, in which case the pairs of bores have a spacing with a peripheral angle of preferably 66°. Located inside this peripheral angle is an intake air slot 32 respectively between two bores 29, 30 or 29', 30', which slot is respectively connected to the inlet channel 9 by way of an intake air bore 33 extending obliquely with respect to the conical bore 25. The longitudinal axes of the intake air slot 32 lie parallel to each other, in which case the inner longitudinal edges of the intake air slots 32 lie approximately as tangents to the center point circle 28. The intake air slots have a radial width corresponding approximately to the radius of the waste air bores. The arrangement is such that the plane of symmetry 31 extending between the waste air bores bisects the intake air slots 32 and the intake air bores 33. With respect to this plane symmetry 31, the waste air bores 29, 29', 30, 30' are staggered in the peripheral direction by a peripheral angle of ±33°.

Also provided in the outer periphery of the distributor 20 is a blind hole bore 34, which is provided for receiving a cotter pin or the like for the non-rotary fixing of the distributor 20 in the casing 6.

The distributor has an approximately triangular cross section, in which case the point of the triangle is directed towards the channel 9.

Figure 2:
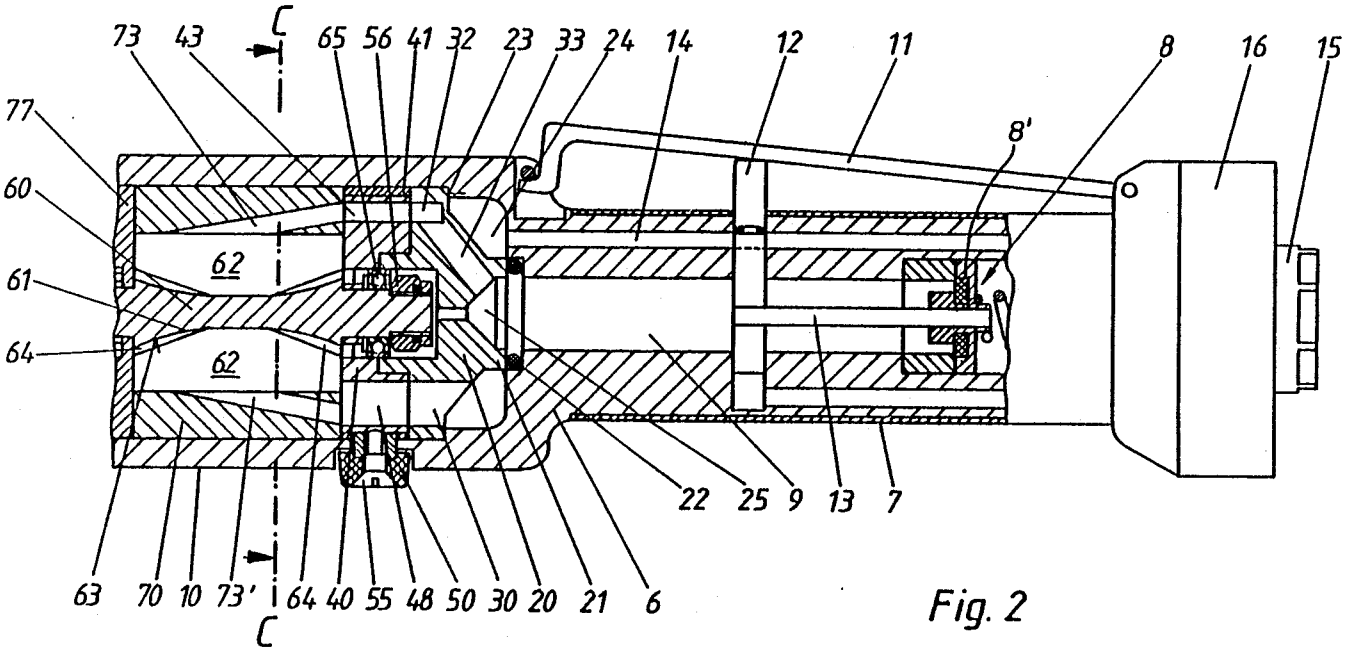
FIG. 2 is an axial partial section through the drive unit of the compressed air wrench.
Figure 5:
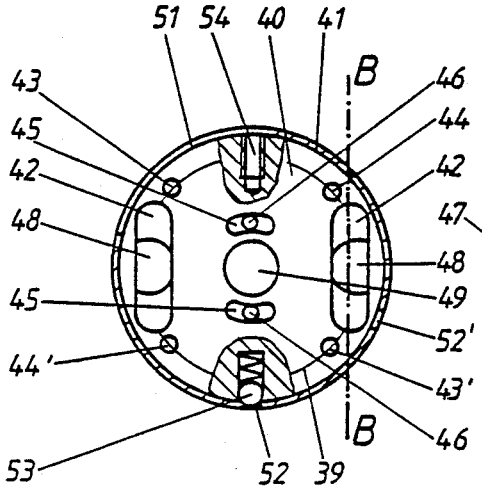
FIG. 5 is a view of a rotor cover, seen from the rotor.
Figure 6:
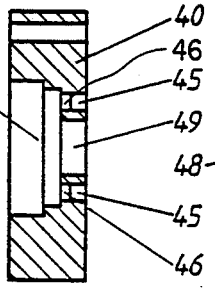
FIG. 6 is an axial section through the rotor cover.
Figure 7:
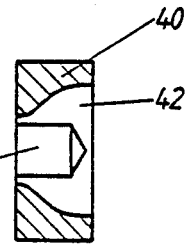
FIG. 7 is a section on line VII—VII of FIG. 5.
Figure 8:
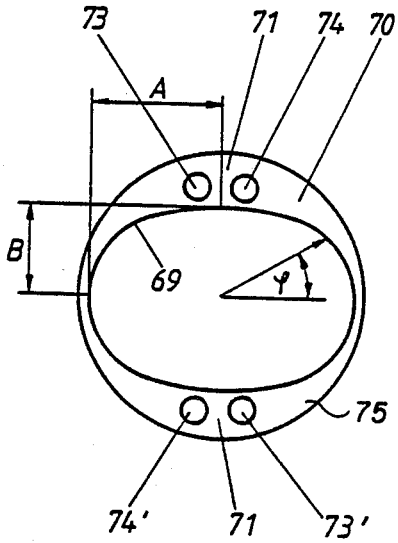
FIG. 8 is a view of the end face of a cylinder of elliptical cross section bearing against the rotor cover.
Figure 9:
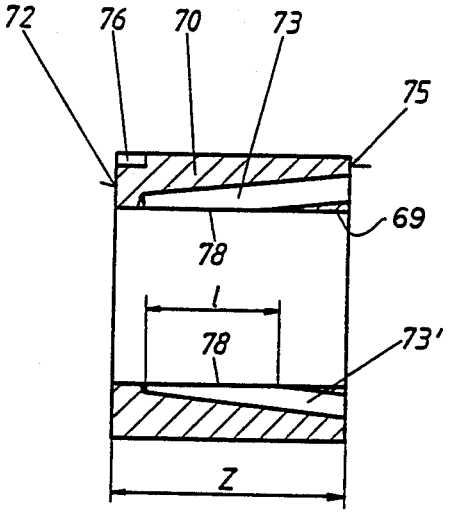
FIG. 9 is an axial section through the cylinder according to FIG. 8;.

As can be seen from FIG. 2, a rotor cover 40 is fitted on the projection 27 of the distributor 20 which cover closes off the end face of a cylinder 70 located in the section 10. The rotor cover 40 is mounted to rotate in an intermediate ring 41 fixed to the casing. The rotor cover 40 thus bears by its end face adjacent the distributor 20 in a substantially tight manner against the annular surface of the distributor and comprises a plurality of bores and openings. As can be seen in detail in FIGS. 5 to 7, two diametrically opposed waste air slots 42 are cut in the side of the rotor cover 40 facing the cylinder 70. The longitudinal axes of the slots 42 in this case lie parallel to each other; their ends are rounded in the shape of a semi-circle. Located respectively in the region of the ends of the slots 42 is an axially continuous intake air channel 43, 43', 44, 44', whereof the parallel axes all lie on a common center point circle 39. The outer longitudinal edges of the waste air slots 42 in this case form approximately tangents to the center point circle 39.

The intake air channels 43, 43', 44, 44' are associated with each other in pairs, in which case the channels of one pair 43, 43' or 44, 44' lie diametrically opposite each other. The intake air channels 43, 44 or 43', 44' adjacent a waste air slot 42 have a spacing in the peripheral direction of preferably 86° and lie close to the longitudinal central axis of the respective waste air slot 42. The connection of the center points of two intake air channels 43, 44, or 43', 44' of a waste air slot lies approximately on the inner longitudinal edge of the respective waste air slot 42.

Provided around a central opening 49 facing the cylinder 70 — staggered with respect to the outlet slots 42 by approximately 90° — are recesses 45 in the shape of part of a circle or which are kidney-shaped, whereof the edges extending in the peripheral direction lie on common circles preferably of 40°. Located approximately centrally in the peripheral direction of a recess is an axially continuous bore 46 opening into the recess 45, which bore opens into a ring-type, two stage enlarged cylindrical recess 47 on the side of the rotor cover 40 facing the distributor 20. The second stage of the recess 47 has an inner diameter corresponding to the outer diameter of the distributor projection 27. The first stage adjoining the opening 49 has an inner diameter corresponding to the inner diameter of the cylindrical projection 27. The depth of the recess 47 is such that the distributor projection 27 can be received completely and the rotor cover 40 bears tightly against the distributor 20.

Each waste air slot 42 preferably has a central, axially continuous waste air channel 48, the diameter of which is preferably greater than the width of the slot 42. The transition from the slot 42 to the waste air channel 48 is constructed to promote flow, which is ensured by a funnel-shaped transition in the channel 48. The wall of the slot 42 thus preferably passes at an angle of 40° into the outlet channel 48, in which case all corners are rounded off. The rotor cover is thus constructed with such a thickness that corners are rounded off. The rotor cover is thus constructed with such a thickness that the transition from the slot 42 into the channel 48 which promotes flow can be constructed in the rotor cover.

A slot 51 is provided in the peripheral direction in the intermediate ring 41 fixed to the casing, which slot has an extent of approximately 66°. A radial threaded blind hole 54 is provided in the rotor cover 40 in the region of the slot 51, which hole 54 serves to receive a screw 55, by which a reversing knob 50 projecting from the casing 6 of the compressed air wrench can be connected to the rotor cover. Two locking openings 52 provided at a distance apart in the peripheral direction for a locking ball 53 are provided in the intermediate ring approximately opposite the peripheral slot 51, which locking ball 53 is biased towards the intermediate ring by a spring located in a radial bore in the rotor cover. The locking openings 52 have a spacing with a peripheral angle of 66°.

The cylinder 70 inserted in the section 10 has an ellipsoidal inner contour 69, which is advantageously constructed to correspond to a double cross loop curve. A curve of this type following the equation:

$$L = \frac{A - B}{2} \times (1 - \cos 2\phi) + B$$

where:

L=distance between curve point and center point
A=large semiaxis
B=small semiaxis
$\phi$=angle of rotation The acceleration and inertia forces occurring on the vanes of a rotor rotating in the cylinder in a construction of this type are the lowest in comparison with other known curve constructions. Furthermore, symmetrical and harmonic loads occur, since points of sudden irregularity due to acceleration and thus great loads on the vanes do not occur. Dynamically balanced running is thus achieved even at high speeds.

Figure 13A:
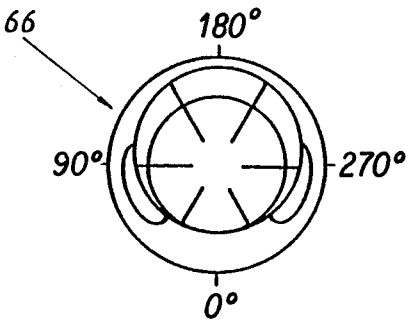
Fig. 13A PRIOR ART
FIG. 13 is an illustration of the acceleration of a vane over the angle of rotation with curve 57 according to the conventional chamber of FIG. 13A and curves 58 and 59 according to the chamber of FIG. 13B.
Figure 13B:
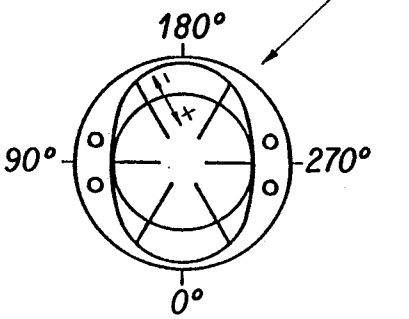
Figure 13:
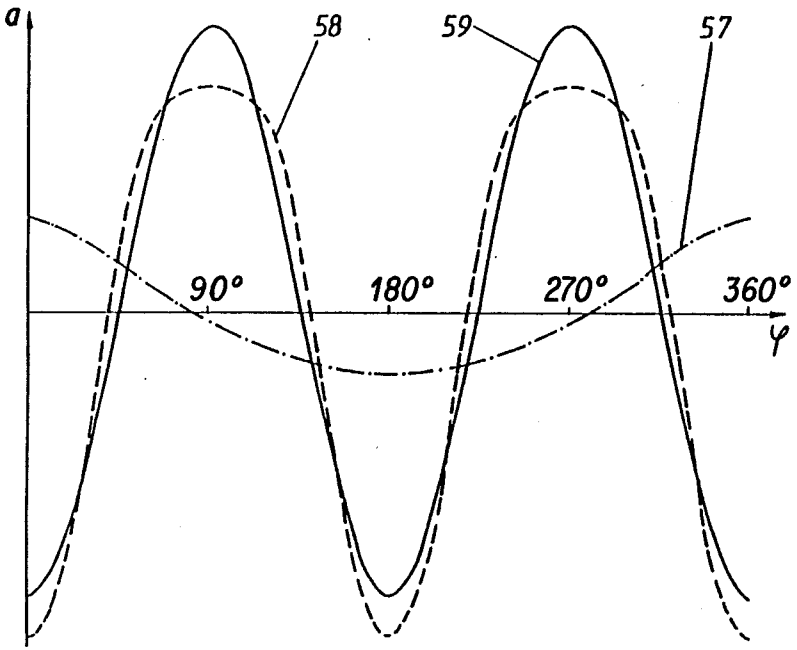
Figure 14:
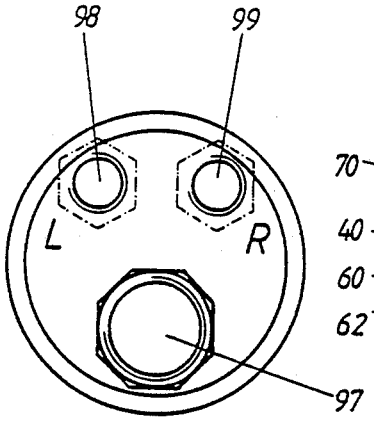
FIG. 14 is a view of the connection side of a compressed air wrench with an automatic device for reversing the direction of rotation.
Figure 15:
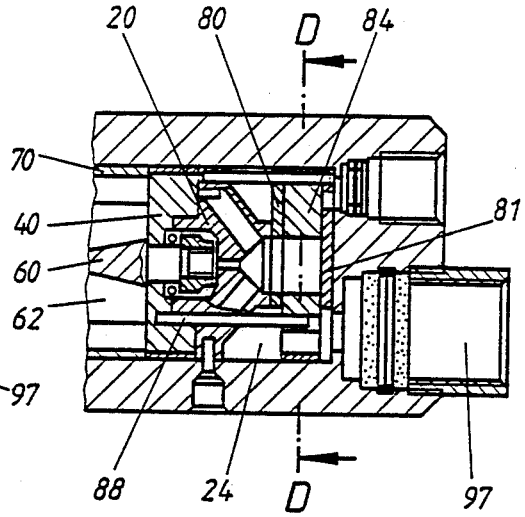
FIG. 15 is an axial section through the device for reversing the direction of rotation.

These advantages may also be achieved with a construction of the inner contour 69 of the cylinder 70 according to a cassinian curve. This cassinian curve follows the equation:

$$L = \sqrt{e^2 \cos 2\phi \pm \sqrt{e^4 \cos^2 2\phi + a^4 - e^4}}$$

where:

$$e^2 = \frac{A^2 + B^2}{2} \quad a^2 = \frac{A^2 - B^2}{2}$$

and:

L=distance between curve point and center point
A=large semiaxis
B=small semiaxis
$\phi$=angle of rotation The acceleration forces acting on the vanes of the rotor are illustrated in FIG. 13 over the angle of rotation. With the conventional form of a twin-chamber compressed air motor with a circular eccentric according to the diagrammatic illustration 66, an acceleration curve 57 is provided. In the construction according to the invention of the twin-chamber compressed air motor according to the cross loop or cassinian curve corresponding to the diagrammatic illustration 67, higher acceleration forces are achieved, which in particular are maximum at the vertices, due to which it is ensured that the vanes bear in a tight manner against the inner contour of the cylinder. Thus the curve 58 corresponds to the cassinian construction and the curve 59 to the construction of the inner contour 69 according to the double cross loop curve.

In the radially thicker part 71 in the plane of the minor semi-axis B, bores 73, 73', 74, 74' are provided in the cylinder, which form the compressed air inlets or outlets for the air. The bores lie diametrically opposite each other in pairs and extend —with axes parallel to each other —inclined axially with respect to the axis of the cylinder, so that their openings 78 on the inner contour 69 of the cylinder are in the form of axial slots. Each slot 78 has a length 1, which amounts to at least more than half the cylinder length Z. A portion of the surface remains at both ends of the slot at the end faces 72 and 75 in order to prevent the introduction of vanes 62 into a slot 78.

The openings of the bores 73, 74 or 73', 74' located on one side of the major semi-axis A in the end face 75 lie on a straight line parallel to the major semi-axis A, in which case they are also located with the same spacing on both sides of the minor semi-axis B. The spacing the bores from each other is slightly greater than the thickness of a vane 62. Due to the fact that the bores located on one side of the major semi-axis A lie close beside each other, trouble free sealing between the compressed air supplied and the waste air is achieved. Furthermore, a very high expansion ratio is achieved, because of the maximum peripheral angle between the inlet and outlet.

A recess 76 opening into the end face 72 is also provided in the outer cylinder casing, engaging in which recess is a pin fixed to the casing for preventing rotation of the cylinder 70.

The rotor 60 of the compressed air motor is located in the cylinder 70. Vanes 62 which are able to move radially are located in axial slots 61 in the rotor. The slots like the vanes extend over the entire length Z of the cylinder 70, in which case the vanes 62 bear tightly against the rotor cover 40 and a closing cover 77 closing off the cylinder 70. The vanes are bevelled slightly at their ends in the base region and when the vane 62 is retracted fully in the radial direction lie at a distance from the base 63 of the slot 61. The gap 64 between the vane and the base 63 of the slot serves for the supply of compressed air, for which purpose the kidney-shaped recesses 45 in the rotor cover 40 are arranged at the height of the gap 64.

One end of the rotor 60 passes in a sealing manner through the closure cover 77 and forms the output shaft, whereas the other end of the rotor 60 projects through the opening 49 in the distributor projection 27 and is guided at this point in a bearing 65. Also screwed to the end of the rotor is a lock nut 56. The end of the rotor, the bearing and the lock nut are arranged so that a passage of air from the connecting bore 26 to the kidney-shaped recesses 45 is possible.

OPERATION

The method of operation of the twin-chamber compressed air motor provided for a compressed air wrench will be described hereafter with reference to FIGS. 10 to 12, which motor comprises a rotor 60 with six vanes. However, the compressed air motor according to the invention is also generally suitable for different applications, in which case its high output with small overall size is advantageous.

Figures 10, 11, 12:
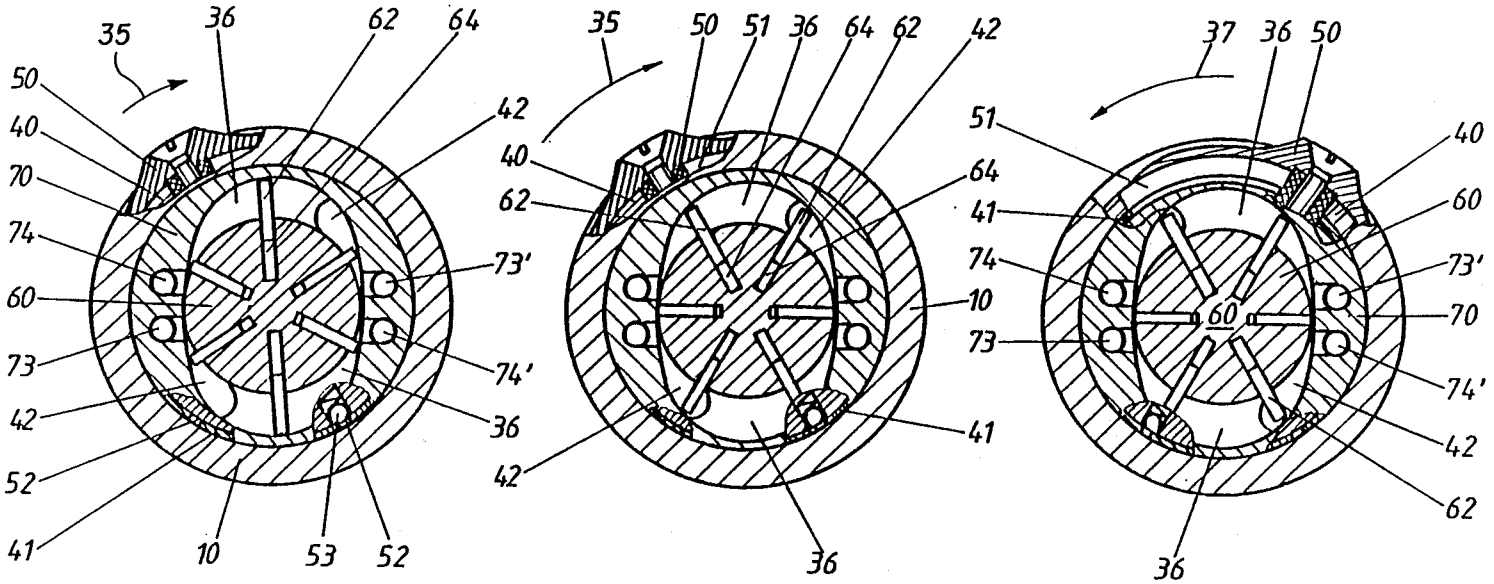
FIG. 10 is a section through the drive unit on line X—X of FIG. 2.
FIG. 11 is an illustration according to FIG. 10 with the rotor rotated approximately through half the spacing of the vanes in the direction of the arrow.
FIG. 12 is an illustration according to FIG. 10 with the rotor cover tilted into the locked position for anti-clockwise rotation.

In the locked position of the rotor cover 40 shown in FIGS. 10 and 11, the rotor 60 is driven in clockwise rotation according to arrow 35. The intake air channels 43, 43' of the rotor cover 40 are connected into the bores 74, 74' in the cylinder 70, whereas the bores 73, 73' of the cylinder 70 are connected to the waste air slots 42. In this locked position, the intake air channels 44 and 44' of the rotor cover 40 are covered by the distributor 20. After depressing the starting lever 11, the compressed air flows by way of the inlet channel 9, the intake air bores 33 and the intake air slots 32 through the distributor 20 to the intake air channels 43 and 43', in order to flow by way of the compressed air inlets 74, 74' into one expansion chamber 36, respectively. On account of the shape of the expansion chamber 36, the rotor experiences a force in the direction of arrow 35, due to which it is rotated in this direction and the following vanes 62 travels over the compressed air inlet 74. The compressed air which has flown into the expansion chamber 36 expands further and drives the rotor in the direction of arrow 35 until the leading vane travels over the waste air slot 42 and the expansion chamber 36 is connected to the outlet channel 14. The waste air flows out axially by way of the waste air slot 42 through the waste air channel 48 and the waste air bore 29 into the waste air chamber 24 and is discharged by way of the waste air channel 14 (FIGS. 2 and 11). The waste air slots 42 are arranged so that one expansion chamber 36 is connected to the waste air slot approximately after half the spacing of the vanes after passing through the major semi-axis A.

If the expansion chamber 36 is pressureless and the waste air slot 42 has largely been passed over, the air compressed on account of the reduction of the expansion chamber is discharged inter alia by way of the bore 73, 73' adjacent the compressed air inlet 74, 74', which bore is connected to the waste air slot 42.

FIG. 12 shows the locked position of the rotor cover 40 for anti-clockwise rotation of the rotor, which is indicated by the arrow 37. In this position of the rotor cover, the bores 74 and 74' are connected to the waste air slots 42, whereas compressed air flows in by way of the bores 73 and 73', which air is supplied by way of the intake air channels 44 and 44', the intake air slots 32 and the intake air bores 33.

The locking positions have a spacing of 66° peripheral angle, so that the rotor cover can be tilted through 66°. The bores which are not functionally effective in a locking position are covered by the non-rotary distributor 20.

The compressed air entering the gap in the base region of the vanes by way of the connecting bore 26 and the kidney-shaped recesses 45 ensures that the vanes bear tightly against the inner contour 69 of the cylinder 70.

On account of the large peripheral angle located between the compressed air inlet and the air outlet formed by the waste air slots, an optimally high expansion ratio is ensured, due to which an increase in output of the compressed air motor with an otherwise unchanged overall size is achieved. On account of this construction, the twin-chamber compressed air motor according to the invention has an efficiency in both directions of rotation which is equal to that of a motor having solely clockwise or anti-clockwise rotation, which is not reversible.

It may be appropriate to equip the compressed air motor with an automatic device for reversing the direction of rotation according to FIGS. 14 to 17. This reversing device consists essentially of two separating discs 80 and 81, between which a housing 81 with a rotary slide valve 83 is located. The rotary slide valve consists essentially of a hollow cylinder 84, which is held centrally in the housing 82 so that it is able to tilt about is longitudinal axis. The cylinder 84 comprises a web 85 projecting radially outwards into the housing 82 in a tight manner, which web is guided in a tight manner in the casing. The web 85 divides two chambers 86 and 87 proved in the casing, which can be pressurized respectively by way of a compressed air connection 98 and 99.

On the side opposite the web, a pin 88 is held in a fork, which pin extends parallel to the axis of the rotary slide valve 83 and engages in the rotor cover 40 which is able to rotate as described previously. A corresponding slot is provided in the distributor 20 over the angle of rotation, in order to ensure resistance-free tilting of the pin, which projects through the distributor.

The housing 82 lies between the two separating discs 80 and 81, in which the separating disc 80 bears against the distributor 20 and comprises an opening corresponding to the taper bore 25. The hollow cylinder 84 is connected to the central opening in the separating disc 80. The end of the hollow cylinder 84 remote from the distributor 20 is closed of in a tight manner by the separating disc 81. Furthermore, the cylinder 84 comprises radial bores 89 and 90, which are arranged so that in one or other end position of the rotary slide valve 83, the pressurized chamber 86 or 87 is connected to the inside of the cylinder 84.

Figure 16:
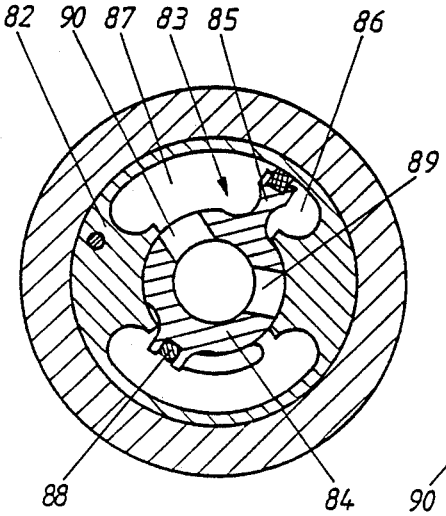
FIG. 16 is a section on line XVI—XVI of FIG. 15.

If compressed air is supplied by way of the connection 98, then the rotary slide valve 83 is moved into the position illustrated in FIG. 16, in which the chamber 87 is connected to the cavity of the cylinder 84. The incoming compressed air thus passes by way of the cylinder 84 to the distributor and - as previously described, into the expansion chambers 36. The waste air may flow out by way of corresponding openings in the separating discs 80, 81 by way of the exhaust 97.

Figure 17:
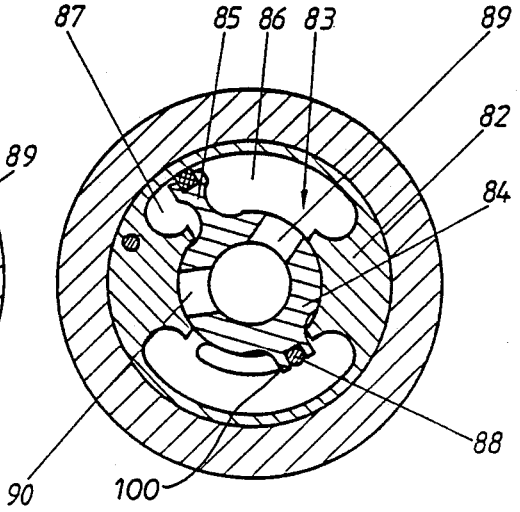
FIG. 17 is an illustration according to FIG. 16 in a reversing position.

If compressed air is supplied by way of the connection 99, then the rotary slide valve 83 tilts into the position shown in FIG. 17, in which case at the same time the rotor cover is tilted accordingly by way of the pin 88. The compressed air now flows by way of the bore 89 to the distributor 20 and from there into the expansion chambers in order to drive the rotor in the clockwise direction.

It may be appropriate to connect the connections 98 and 99 jointly by way of a two-way valve to a source of compressed air. A reversal of the direction of rotation may then be achieved directly by switching the two-way valve.

The arrangement of the automatic device for reversing the direction of rotation in the flow direction of the incoming compressed air in front of the rotor cover or distributor has the advantage that the rotor cover can be moved without force. The incoming compressed air first of all actuates the reversing device and tilts the rotor cover, before the latter is acted upon by compressed air.

I claim:

1. A reversible twin-chambered compressed-air motor comprising:

a cylinder having at least a substantially elliptical internal contour;

a rotor constructed and arranged to fit within said cylinder so that a chamber is formed on either side of said rotor;

a plurality of radially sliding vanes uniformly distributed about the periphery of said rotor, said radially sliding vanes extending over the entire length of said cylinder and being fitted in axial slots in said rotor;

said cylinder having a closing cover and a rotor cover fitted on either end of said rotor to form with said cylinder; said rotor and two of said vanes a pair of chambers for compressed air;

said rotor cover being rotatably sealed for alternately connecting said cylinder to a compressed-air inlet and an air outlet;

said air outlet constructed and arranged to lie in a rotating direction of said rotor behind the large semi-axis of said substantially elliptical internal contour of said cylinder during both clockwise and anti-clockwise operation.

2. The reversible twin-chambered compressed-air motor as defined in claim 1, wherein the distance of said air outlet from the large semi-axis of said substantially elliptical internal contour of said cylinder, measured in a peripheral direction corresponds to approximately one-half of a vane division.

3. The reversible twin-chambered compressed-air motor as defined in claim 2, wherein said air outlet consists of at least one outlet slot in said rotor cover, which outlet slot extends tangentially to a center-point circle of said rotor cover and is connected with an axially through-going outlet duct.

4. The reversible twin-chambered compressed-air motor as defined in claim 3, wherein said outlet slot passes into an air outlet duct once having passed through said rotor cover.

5. The reversible twin-chambered compressed-air motor as defined in claim 4, further including mutually diametrically opposed compressed-air inlets in said cylinder for clockwise operation and mutually diametrically opposed compressed-air inlets in said cylinder for anti-clockwise operation, which mutually diametrically opposed compressed-air inlets begin at a face of said cylinder and open into an inside wall of said cylinder, said rotor cover having two diametrically opposed, axially through-going supply air ducts provided for clockwise and anti-clockwise operation, whereby one pair of said through-going supply air ducts can be connected with said compressed-air inlets for clockwise operation, and the other pair of through-going supply air ducts can be connected with said compressed-air inlets for anti-clockwise operation such that there will always be at least one outgoing air slot provided whose longitudinal axis is parallel with said supply air ducts.

6. The reversible twin-chambered compressed-air motor as defined in claim 5, wherein the external longitudinal edges of said outgoing air slots lie in a substantially tangential relationship to a center point circle drawn through said supply air ducts and the internal longitudinal edges of said outgoing air slots are situated approximately on the center point of a connecting line between the respective neighboring supply air ducts.

7. The reversible twin-chambered compressed-air motor as defined in claim 6, wherein said rotor cover has two diametrically opposed recesses which can be acted upon by compressed air, said recesses being supplied preferably through a bore situated centrally with respect to said recesses and wherein said recesses are displaced with respect to the outgoing air slots at a circumferential angle of 90°.

8. The reversible twin-chambered compressed-air motor as defined in claim 7, wherein said rotor cover is rotatably mounted in an intermediate ring in said housing and said rotor cover on the inlet side and the rotor are mounted by a cylindrical projection on an air distributor.

9. The reversible twin-chambered compressed-air motor as defined in claim 8, wherein said rotor cover can be locked in one of two rotating positions; whereby, in a first position, one pair of said diametrically opposed supply air ducts is connected with compressed-air inlets for clockwise operation and the other pair of compressed-air inlets for anti-clockwise operation are connected with said outgoing air slot whereby in a second position said second pair of diametrically opposed supply air ducts are connected with compressed air inlets for anti-clockwise operation and said compressed-air inlets for clockwise operation are connected with said outgoing air slots.

10. The reversible twin-chambered compressed-air motor as defined in claim 9, wherein said compressed-air inlets in said cylinder are bores beginning at a face of said cylinder which is situated at an angle with respect to the cylinder axis near the small semi-axis of said substantially elliptical internal contour.

11. The reversible twin-chambered compressed-air motor as defined in claim 10, wherein said bores which open into the internal contour of said cylinder are substantially longer than 50% of the length of said cylinder.

12. The reversible twin-chambered compressed-air motor as defined in claim 11, wherein said bores which are provided at one side of said large semi-axis are separated by a distance which is slightly larger than the thickness of one of said vanes.

13. A reversible twin-chambered compressed-air motor comprising:

a cylinder having a substantially elliptical internal contour;

a rotor constructed and arranged to fit within said cylinder so that a chamber is formed on either side of said rotor;

radially sliding vanes uniformly distributed around said rotor within the internal contour of said cylinder, said vanes ranging over the entire length of said cylinder and fitted into axial slots in said rotor;

said cylinder being closed on its end by a cover plate and a rotor cover to form a pair of chambers for compressed air with said vanes, which expansion chambers can be alternately connected to a compressed-air inlet for either clockwise or anti-clockwise rotation, wherein the substantially elliptical internal contour of said cylinder is described by the following equation:

$$L = \frac{A - B}{2} \times (1 - \cos 2\phi) + B$$

where:

L=distance of curve point to center point

A=large semi-axis

B=small semi-axis $\phi$=angle of rotation.

14. A reversible twin-chambered compressed-air motor comprising:

a cylinder having a substantially elliptical internal contour;

a rotor constructed and arranged to fit within said cylinder so that a chamber is formed on either side of said rotor;

radially sliding vanes uniformly distributed within the periphery of said cylinder, said vanes ranging over the entire length of said cylinder and fitted in axial slots in said rotor;

said cylinder being closed on its end by a closing cover and a rotor cover to form a pair of chambers for compressed air with said vanes, which expansion chambers can be alternately connected to a compressed-air inlet for either clockwise or anti-clockwise rotation, wherein the internal contour of said cylinder is described by the following equation:

$$L = \sqrt{e^2 \cos 2\phi \pm \sqrt{e^4 \cos^2 2\phi + a^4 - e^4}}$$

$$e^2 = \frac{A^2 + B^2}{2} \quad a^2 = \frac{A^2 - B^2}{2}$$

where:

L=distance of curve point to center point

A=large semi-axis

B=small semi-axis $\phi$=angle of rotation.

15. A reversible twin-chambered compressed-air motor comprising:

a cylinder having a substantially elliptical internal contour;

a rotor constructed and arranged to fit within said cylinder so that a chamber is formed on either side of said rotor;

radially sliding vanes uniformly distributed about the periphery of said rotor, said radially slidings vanes ranging over the entire length of said cylinder;

said radially sliding vanes being fitted into axial slots, whereby said cylinder is closed on its ends by a cover plate and a rotor cover plate;

said cylinder cover plate, said rotor cover said vanes said rotor and said cylinder forming a pair of expansion chambers, which expansion chambers depending on the rotatable position of said rotor cover can be alternately connected to a compressed-air inlet and an air outlet;

an automatic reversing device for reversal of the rotating direction of the reversible twin-chambered compressed-air motor, said automatic reversing device being actuated by a flow of supplied compressed air.

16. The reversible twin-chambered compressed-air motor as defined in claim 15, wherein said automatic reversing device includes a rotary valve, which rotary valve can be shifted by means of a first compressed-air connection into a first position and by means of a second compressed-air connection into a second position.

17. The reversible twin-chambered compressed-air motor as defined in claim 16, wherein said rotary valve is mechanically connected with said rotor cover, said connection causes said rotor cover to rotate with respect to said rotary valve.

18. The reversible twin-chambered compressed-air motor as defined in claim 17, wherein said automatic reversing device is axially connected at a distance from said rotor to a compressed-air distributor and said rotary valve carries a pin which passes axially through said air distributor, which pin emerges said rotor cover and is pivoted at the opposite end of said air distributor.

* * * * *